US005249367A

United States Patent [19]

Nafziger et al.

[11] Patent Number: 5,249,367

[45] Date of Patent: * Oct. 5, 1993

[54] NAIL DRYING APPARATUS AND METHOD THEREFOR

[75] Inventors: Michael D. Nafziger, Scottsdale; Roger L. Davis, Tempe, both of Ariz.

[73] Assignee: Ultraset Limited Partnership, Scottsdale, Ariz.

[ * ] Notice: The portion of the term of this patent subsequent to Jul. 14, 2009 has been disclaimed.

[21] Appl. No.: 848,538

[22] Filed: Mar. 9, 1992

Related U.S. Application Data

[63] Continuation-in-part of Ser. No. 235,349, Aug. 23, 1988, abandoned, and a continuation-in-part of Ser. No. 394,200, Aug. 15, 1989, Pat. No. 5,130,551, which is a continuation-in-part of Ser. No. 235,349, Aug. 23, 1988, abandoned.

[51] Int. Cl.[5] ..... F26B 3/28

[52] U.S. Cl. ..... 34/1 Y; 34/202

[58] Field of Search ..... 34/202, 4, 1 Y; 250/492.1, 493.1

[56] References Cited

U.S. PATENT DOCUMENTS

| | | | |
|---|---|---|---|
| 2,673,402 | 3/1954 | Chambers | 34/202 |
| 3,864,847 | 2/1975 | Friedman et al. | 34/202 |
| 5,130,551 | 7/1992 | Nafziger et al. | 34/202 |

*Primary Examiner*—Henry A. Bennet
*Attorney, Agent, or Firm*—Harry M. Weiss

[57] ABSTRACT

A nail drying apparatus including a housing having lower and upper adjustable portions and including an ultraviolet light source enclosed therein. The housing has left and right hand or feet openings for positioning both hands, or feet, on left hand or foot and right hand or foot rest positions within the housing, for drying the nails. A method of drying the nails is also provided.

7 Claims, 2 Drawing Sheets

NAIL DRYING APPARATUS AND METHOD THEREFOR

RELATED APPLICATIONS

This application is a continuation-in-part application to our earlier application, U.S. Ser. No. 07/235,349, filed Aug. 23, 1988 now abandoned. This application is also a continuation-in-part application to our earlier application U.S. Ser. No. 07/394,200; filed Aug. 15, 1989 now U.S. Pat. No. 5,130,551 which is a continuation-in-part to our first filed patent application U.S. Ser. No. 07/235,349, filed Aug. 23, 1988 that is now abandoned.

BACKGROUND OF THE INVENTION

This invention generally relates to a nail drying apparatus and method therefor, and in particular the invention relates to a nail drying apparatus and method for drying nails for both left and right hands, or for both left and right feet wherein drying of the nails thereof is achieved by exposure of the nails to ultraviolet radiation, and wherein separator means are provided for selectively positioning an ultraviolet light sub-assembly at a selected distance from the nails.

FIELD OF THE INVENTION

In the past, nail polish and enamels were usually air dried after they were applied in an effort to try to speed up the very slow drying process. Even this air drying process required a very long period of time before the nail polish dried on the nails. While waiting for the polish to dry, the polish wearer had to be extremely careful to avoid touching the surface of the nails, or else the polish would smear or smudge, resulting in a ruined manicure. In effect, the nail polish user or wearer was prevented from using their hands in any normal everyday activity while the polish was drying. This especially proved burdensome for beauty salon customers who needed to manipulate or handle purses, car keys and other objects immediately after receiving a manicure.

Realizing the burden that the air drying method placed on people with freshly manicured hands containing wet nail polish, various devices were developed to try to expedite the drying process. (See, U.S. Pat. Nos. 2,374,472 and 2,262,274). These devices, generally consisted of a box-like type dryer which blew or circulated hot or cold air onto the wet surface of each of the nails for a specified period of time. However, these devices, if successful, could only dry the top nail polish protection coating on each nail and did not dry the nail polish located underneath the top coating. Consequently, additional exposure for an extended period of time to the drying air was usually required to dry the lower coating or coatings of nail polish and the manicure was still easily ruined if the nail's surface came into contact with another hard surface or object. As a result, nail polish users or wearers still had to use their hands cautiously for relatively long periods of time so as not to ruin the manicure.

U.S. Pat. No. 3,928,113 discloses a multi-step drying process for coating and drying nails comprised of the steps of applying a water soluble base coat to the nails, allowing the base coat to dry, then applying a photocurable nail lacquer, and then curing the lacquer by exposing it to sufficient amounts of radiation.

U.S. Pat. No. 4,596,260 discloses a process of applying a photocurable coating to an artificial nail tip whereby upon exposure to suitable radiation the coating hardens to give the appearance of a natural nail.

Accordingly, a need existed for a safe, rapid, adjustable dosage, nail drying apparatus and method therefor, which utilizes ultraviolet radiation from an adjustably mounted radiation source and which simultaneously dries nails on either both hands, or simultaneously dries nails on both feet.

SUMMARY OF THE INVENTION

An object of the present invention is to provide a safe, nail drying apparatus and method therefor which utilizes ultraviolet radiation in a safe dosage from an adjustably mounted radiation source.

Another object of the present invention is to provide a rapid nail drying apparatus and method therefor which either simultaneously dries nails on both hands, or simultaneously dries nails on both feet.

Yet another object of the present invention is to provide a safe nail drying apparatus and method therefor which automatically shuts off a nail drying radiation after a preselected time interval.

Yet still another object of the present invention is to provide a safe nail drying apparatus and method therefor which equally and simultaneously supplies a selected radiation dosage to the left hand (foot) nails and an equal radiation dosage to the right hand (foot) nails.

Presently, in nail salons and homes around the world, nail polish is applied in a three step process.

BRIEF DESCRIPTION OF THE PREFERRED EMBODIMENT

First, a base-coat is applied or used to fill ridges in the nail and to prevent the colored polish or enamel, applied in the next step from staining the natural nail.

Second, two coats of colored polish or enamel are applied. Two coats are preferably used in order to provide an opaque and colorful finish.

Third, a clear top coat is applied to protect the nail polish or enamel, applied in step two, to give it a prominent shine and provide extended wear.

The present invention provides an apparatus and method which utilizes photo-reactive coating for nails that is applied to the nails as the top coat in the above described third step. The present invention also provides an apparatus that includes a housing which adjustably supports a source of ultraviolet radiation, for applying a safe dosage that irradiates the top coat on each nail causing the coating to react and dry within a few minutes, and which has rest portions for left and right hand (or feet) for simultaneously drying the nails thereof.

These and other objects, features and advantages of the present invention, as well as details of the preferred embodiment thereof, will be more fully understood from the following description and drawing.

DESCRIPTION OF THE PREFERRED EMBODIMENT

Figure 1:
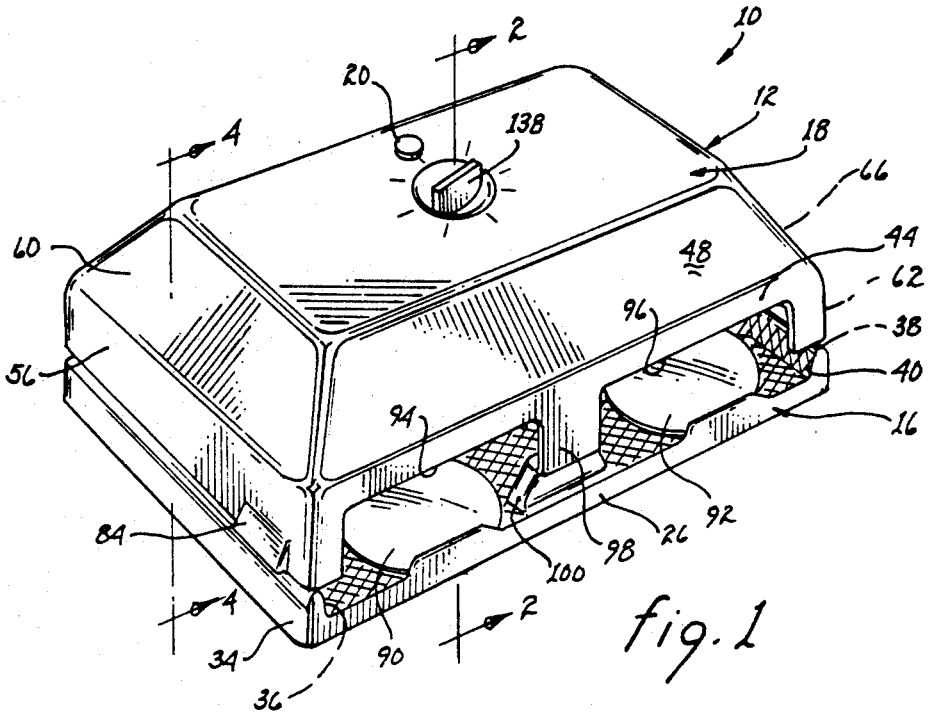
FIG. 1 is a perspective view of the preferred embodiment of the present invention.

As shown in FIG. 1, a nail drying apparatus 10 is provided. Apparatus 10 includes a housing 12, and an ultraviolet light subassembly or source 14 (see FIG. 2).

Housing 12 has a lower portion 16 (see FIG. 1), an adjustable portion 18 hinged to lower portion 16, and an adjustable separator 20, which is disposed between portions 16, 18. As shown schematically in FIG. 4, lower portion 16 supports a person's hand 19 with nails 21.

Lower portion 16 has a bottom wall 22 (see FIGS. 2, 3*a* and 3*b*) and liner 28 (see FIG. 2), a front wall 26 (see FIGS. 1 and 2), and liner 28 (see FIG. 2), a rear wall 30 and liner 32 (see FIG. 2), a left wall 34 and liner 36, and a right wall 38 and liner 40 (see FIG. 1).

Upper portion 18 has a top wall 42 (see FIG. 2), a front wall 44 and liner 46, a front inclined wall 48, a rear wall 50 and liner 52 and a rear inclined wall 54. Upper portion 18 also has a left wall 56 (see FIG. 1), and liner 58 (see FIG. 5), a left inclined wall 60 (see FIG. 1), a right wall 62 (see FIG. 1), and liner 64 (see FIG. 5), a right inclined wall 66 (see FIG. 1), and a partition wall 68 (see FIG. 2), and liner 70.

Figure 5:
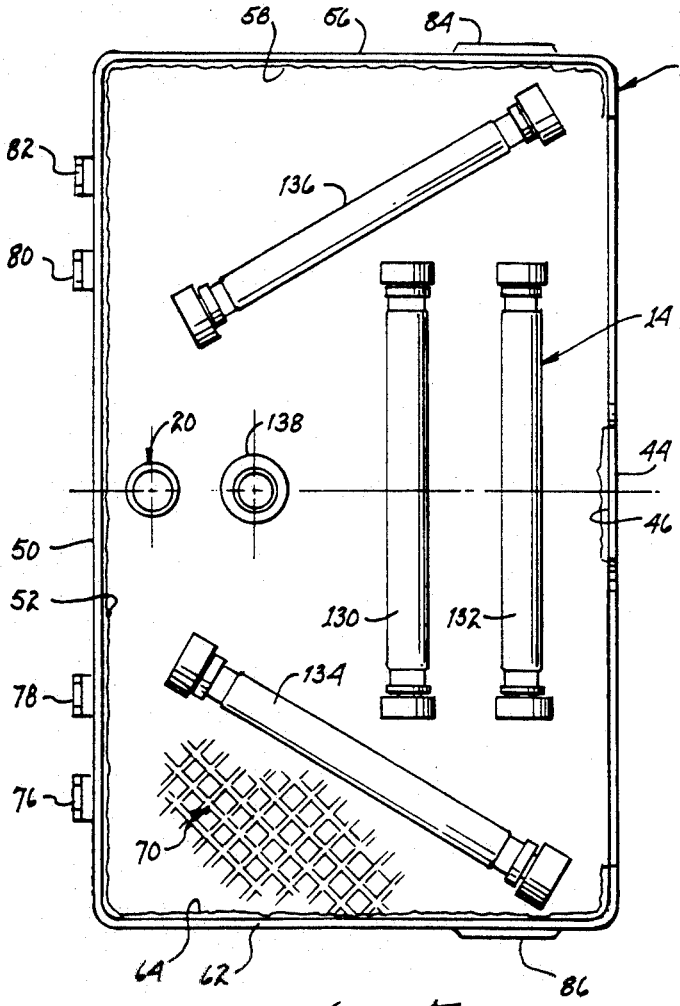
FIG. 5 is a cross-sectional view of the preferred embodiment of FIG. 1 taken along line 5—5 of FIG. 2.
Figure 6:
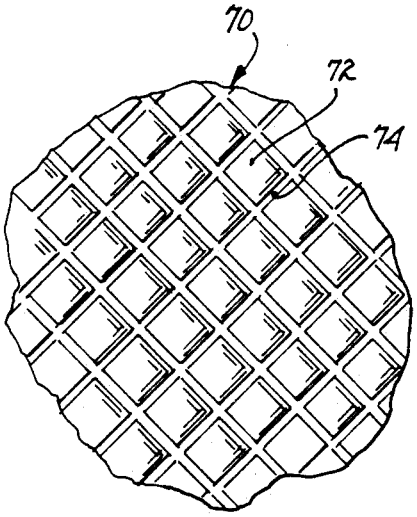
FIG. 6 is an enlarged view of a portion of FIG. 5

As shown in FIGS. 5 and 6, partition liner 70, which is typical of all the liners, has spaced, inner surface, raised portions or hills 72, and has spaced recessed portions or valleys 74 which are disposed between hills 72. Typical liner 70 is made of a conventional liner type material, such as a material that is opaque to ultraviolet light. Partition wall 68, like all of the walls, is made of a conventional structural type material such as metal or a plastic material.

Bottom rear wall 30 (see FIG. 1) has spaced, outer hinges 76, 78, 80, 82 (see FIG. 5), which are each connected to top rear wall 50. Top left wall 56 and top right wall 62 (set FIG. 1) have respective finger lift projections or bars 84, 86 (see FIG. 5). Bottom left wall 34 and bottom right wall 38 (see FIG. 1) have a plurality of underside legs 88 (see FIG. 4).

Bottom wall 22 (see FIG. 2) has left and right hand (or foot) rest portions 90, 92 (see FIG. 1) where portions of the liner 24 is cut out or removed. Rest portions 90, 92 rest each hand 19 with nails 21 positioned for drying to coating thereon. Upper front wall 44 (see FIG. 2) has left and right openings 94, 96 (see FIG. 1) which have a front wall portion 98 disposed between openings 94, 96. Bottom front wall 26 (see FIG. 2) has an upstanding portion 100 (see FIG. 1) which is overlapped by upper front wall portion 98, and which is disposed between openings 94, 96.

Left rest portion 90 and left cut out or opening 94 define a left chamber for the left hand or foot. Right rest portion 92 and right cut out 96 define a right chamber or cavity for the right hand or foot. The rest portions 90, 92 are symmetrical about a transverse plane or axis through separator 20 and through a center of front wall portion 98, and the ultraviolet light source 14 is also symmetrical about such plane, so the left and right hands or feet, and the nails thereon, receive equal respective radiation dosages.

Separator 20 is adjustable for adjusting the size of gap or distance 102 (see FIG. 4) between front walls 26, 44 at the corners thereof, and for adjusting a corresponding angle of tilt of this upper housing 18 relative to the lower housing 16.

Figure 2:
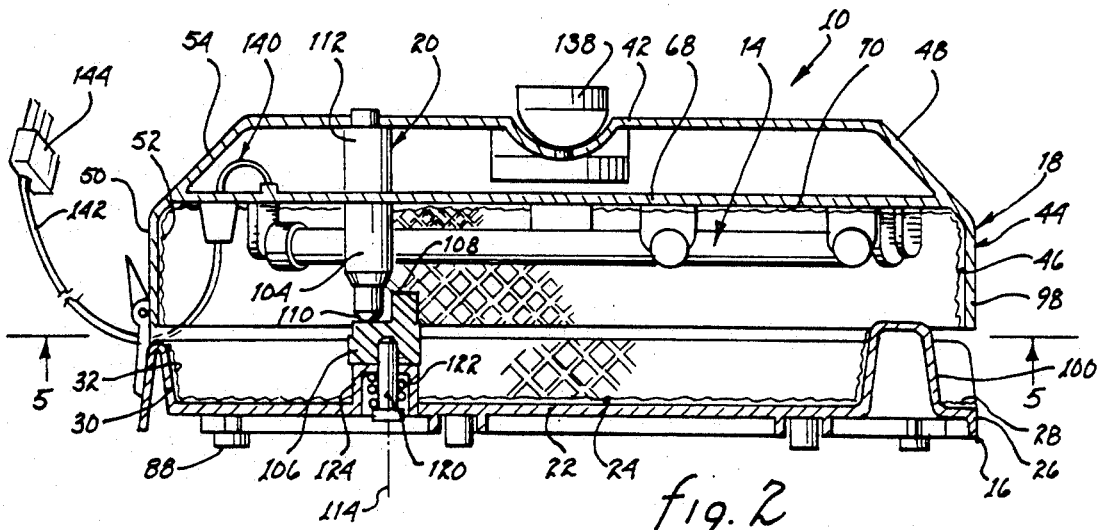
FIG. 2 is a cross-sectional view of the preferred embodiment of FIG. 1 taken along line 2—2 of FIG. 1.
Figure 3A:
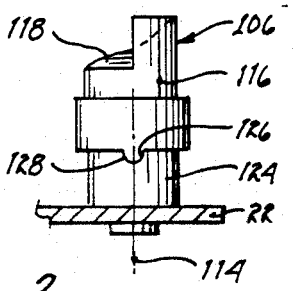
FIG. 3*a* is an enlarged view of a portion of FIG. 2.
Figure 3B:
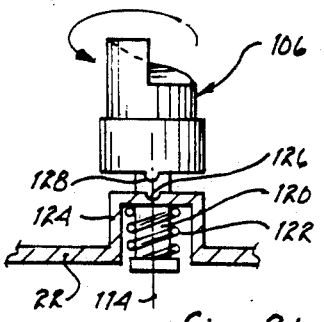
FIG. 3*b* is an enlarged view of the portion of FIG. 3*a*, when lifted.
Figure 4:
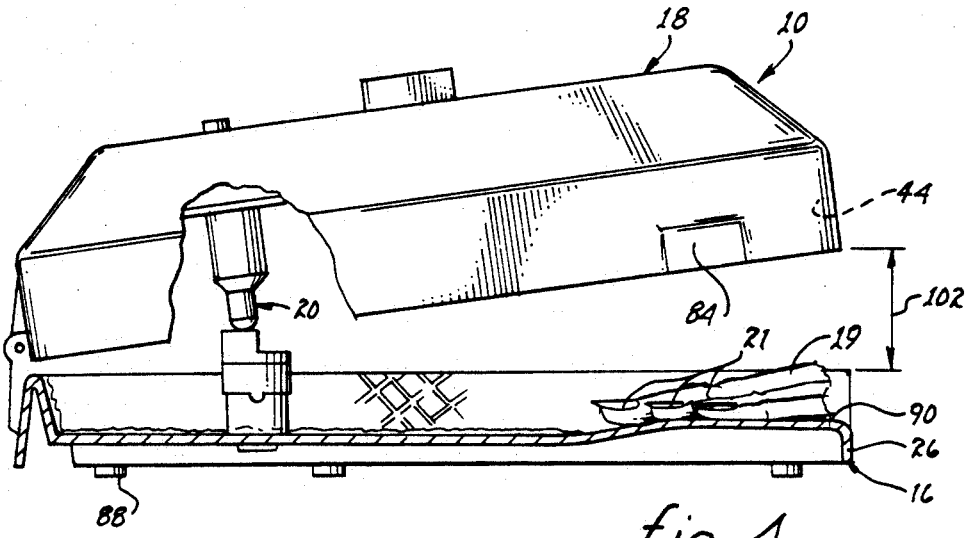
FIG. 4 is a cut away elevation view of the preferred embodiment of FIG. 1 taken along line 4—4 of FIG. 1.

As shown in FIG. 2, separator 20 has an upper pin or stud 104 and a lower cylinder or adjustable-height member 106. Pin 104 has a bottom end 108 with a semi-spherical bearing surface 110 and has a top end 112 which is fixedly connected to top wall 42. Pin 104 also extends through a hole in partition wall 68. Cylinder 106 has an axis 114 about which it is angularly displaceable or rotatably adjustable. Cylinder 106 has a top end 116 (see FIG. 3*a*) which has an adjustable, helical or spiral, end surface 118, for setting the value of distance 102 (see FIG. 4). Cylinder 106 has a threaded bolt 120 (see FIG. 3*b*) with a compression spring 122 which is further compressed when cylinder 106 is lifted. Bottom walls 22 has a hollow raised portion 124 (see FIGS. 2 and 3*b*) which supports cylinder 106. Raised portion 124 has a plurality of angularly spaced grooves 126 on its surface. Cylinder 106 has an underside projection 128 which is received by any one of the grooves 126 as desired. As shown in FIG. 3*b*, cylinder 106 can be lifted and rotated and its projection 128 then placed in any other of the grooves 126, thereby changing gap 102. By setting a desired or selective gap 102, a user sets the distance of ultraviolet light source 14 from nails 21 of hand 19 and thereby controls the radiation intensity. The size of distance 102, as shown in FIG. 4, is minimized in order to minimize the amount of exposure of the user to emitted UV radiation from source 14.

As shown in FIG. 5, ultraviolet light source 14 preferably has first and second parallel radiation lamps 130, 132, first and second diagonal radiation lamps 134, 136, an adjustable timer switch 138 and a conductor circuit 140 (see FIG. 2). Circuit 140 has a conductor wire 142, which has a plug 144 suited to a 110 volt alternating current outlet. Circuit 140 is a conventional circuit which interconnects lamps 130, 132, 134, 136 and switch 138.

In operation, after a final (UV) photo-reactive coating is applied to the nails 21, the user's nails 21 on the left and right hands 19 are positioned on the rest portions 90, 92 in the apparatus 10. Before or after placing the hands 19 in apparatus 10, the timer switch 138, the gap 102, which is a minimum size gap, is set by adjusting separator 20.

This method of drying nails includes, applying a photo-reactive polish as a final layer to each of the fingernails 21; simultaneously positioning the finger nails 21 on left and right hand position within the housing of the apparatus having radiation resistant walls; and exposing the nails 21 to radiation for a preselected time interval from an ultraviolet light source disposed at a preselected distance from the nails.

The advantages of apparatus 10 and the method therefor are indicated hereafter.

A) An adjuster or separator 20 permits adjustment of the distance from an ultraviolet light source 14 to the nails 21 on the hand 19, or foot, of a user. Thereby permitting a safe radiation distance, to thereby provide a safe nail drying apparatus 10.

B) Left and right hand, or foot, rest portions 90, 92 define left and right chambers which permits simultaneous drying of the nails on the left and right hands or feet, to assure a rapid nail drying apparatus 10.

C) An ultraviolet light source 14 with a circuit 140 and timer switch 138 permits accurate pre-setting of the radiation time interval, and also permits automatic shut-off, to provide a safe nail drying apparatus 10.

D) Symmetrical arrangements of ultraviolet light source 14 and rest portions 90, 92 assure substantially equal radiation dosages to the nails of the left and right hands, or feet, thereby assuring a safe and easily controlled nail drying apparatus 10.

While the invention has been described in its preferred embodiment, it is to be understood that the words which have been used are words of description rather than limitation and that changes may be made within the purview of the appended claims without departing from the true scope and spirit of the invention in its broader aspects.

We claim:

1. A nail drying apparatus comprising:

a housing having ultraviolet radiation resistant lower and upper portions;

an ultraviolet light source disposed within the housing;

means for adjusting the positioning of the ultraviolet light source with respect to a person's nails; and nail positioning means located in the lower portion for positioning a person's nails relative to said ultraviolet light source.

2. The apparatus of claim 1 wherein the nail positioning means includes a left hand or foot rest portion means and a right hand or foot rest portion means for simultaneously drying nails on the left hand or foot and right hand or foot.

3. A nail drying apparatus comprising:

a housing having radiation resistant lower and upper portions;

an ultraviolet light source disposed within the housing;

means for adjusting the positioning of the ultraviolet light source with respect to a person's nails; and nail positioning means located in the lower portion for positioning a person's nails relative to said ultraviolet light source; the adjusting means including hinge means connected to the lower and upper portions for tilting the upper portion relative to the lower portion for coarse adjusting of a distance from the ultraviolet light source to the nails, and includes a separator having a bearing pin fixedly connected at a first end to the upper portion and having an adjustable cylinder with an end helical bearing surface engaging a second end of the pin and being rotatably connected to the lower portion for fine adjusting of the distance from the ultraviolet light source to the nails to accurately control radiation intensity on the nails.

4. The apparatus of claim 2 wherein the upper portion has a front wall having a left hand or foot cutout and a right hand or foot cutout for positioning a left hand or foot, on the left hand rest portion and a right hand or foot, on the right hand or foot rest portion to simultaneously dry nails on both hands, or on both feet.

5. The apparatus of claim 1 wherein both the lower portion and the upper portion each have a plurality of walls, each one of said plurality of walls having an outer structural layer and an inner radiation resisting layer to prevent radiation passage through the walls to the exterior thereof.

6. The apparatus of claim 1 wherein the ultraviolet light source includes a plurality of lamps, a timer switch and a circuit interconnecting the lamps and switch for connection to a power supply.

7. A method of drying nails including the steps of:

applying a coat of photo-reactive polish as a final layer to selected nails;

positioning both left and right hand or foot nails in left and right hand or foot positions which are disposed at about equal distances from an ultraviolet light source within a housing having ultraviolet radiation resistant walls; and applying ultraviolet radiation from said ultraviolet light source within said housing onto the nails for rapidly drying the nails.

* * * * *